United States Patent [19]

Johns

[11] 4,420,087

[45] Dec. 13, 1983

[54] ARTICLE DISPLAY DEVICES

[76] Inventor: Robert L. Johns, 927 Azalea La., Vero Beach, Fla. 32960

[21] Appl. No.: 222,246

[22] Filed: Jan. 2, 1981

Related U.S. Application Data

[63] Continuation-in-part of Ser. No. 129,686, Mar. 12, 1980, Pat. No. 4,323,163, which is a continuation-in-part of Ser. No. 116,404, Jan. 29, 1980, abandoned.

[51] Int. Cl.[3] ..... A47F 5/00

[52] U.S. Cl. ..... 211/189; 52/588; 52/593; 248/220.3

[58] Field of Search ..... 211/189, 183, 87, 94; 248/220.3; 52/588, 593, 594, 570, 579

[56] References Cited

U.S. PATENT DOCUMENTS

| | | | |
|---|---|---|---|
| 2,142,110 | 1/1939 | Calkins et al. | 52/579 |
| 3,289,375 | 12/1966 | Cline | 52/570 |
| 3,557,511 | 1/1971 | Curran | 52/588 |
| 3,895,720 | 7/1975 | Presberg | 211/126 |
| 3,992,839 | 11/1976 | La Borde | 52/570 |

FOREIGN PATENT DOCUMENTS

| | | | |
|---|---|---|---|
| 454573 | 2/1949 | Canada | 52/593 |
| 791124 | 9/1935 | France | 52/579 |
| 1580113 | 7/1969 | France | 52/594 |
| 605667 | 6/1960 | Italy | 52/570 |

*Primary Examiner*—Ramon S. Britts
*Assistant Examiner*—Robert W. Gibson, Jr.
*Attorney, Agent, or Firm*—Carroll F. Palmer

[57] ABSTRACT

Article display units are formed by assembling together a plurality of elongated members to form a panel containing slots on at least one of the surfaces. The elongated members are contoured to interlock with one another via integral lug elements and complimentary leg elements thereby creating panels of any desired surface dimensions. The panels may be formed as free-standing or wall-mounted units. Brackets or other article support devices are hooked into the panel slots at desired locations to support and display merchandise or the like.

20 Claims, 41 Drawing Figures

ARTICLE DISPLAY DEVICES

CROSS-REFERENCE TO RELATED APPLICATIONS

This application is a continuation-in-part of Ser. No. 129,686, filed Mar. 12, 1980, now U.S. Pat. No. 4,323,163, which in turn is a continuation-in-part of Ser. No. 116,404, filed Jan. 29, 1980 now abandoned. The disclosures of these prior co-pending applications are incorporated herein by reference.

BACKGROUND OF THE INVENTION

1. Field of the Invention

This invention broadly relates to article display units. More particularly it concerns interlocking members that may be assembled to form slotted panels into which article support devices may be hooked.

2. Description of the Prior Art

Boards or panels upon which articles may be hung or supported for display, storage or other purpose are well known in the art. An example of such items is the so-called "Peg Boards" that have numerous holes therein by which support devices of various configurations may be hooked.

Another basic form of article display units comprise panels that have horizontal slots or channels into which article display devices may be hooked, e.g., see U.S. Pat. Nos. 3,172,540 and 3,235,218. The present invention provides improved forms of article display units of this general type.

It is also known in the art to form longitudinal members, such as by rolling or extrusion of metal or plastic, that are structured so that various members may be interlocked with one another to produce an assembly for mounting or supporting a wide variety of items, e.g., see U.S. Pat. No. 3,425,568. This basic concept has even been utilized in the production of mounting assemblies that have a series of parallel slots in one or both surfaces of a panel unit, e.g., see U.S. Pat. No. 3,352,428. The present invention utilizes this general concept of assembly construction to provide article display units of improved design.

OBJECTS

A principal object of this invention is the provision of new and improved forms of article display units.

Further objects are the provision of:

1. Display panel members that are independent and attach to the next panel member with a slot-socket system on center.
2. Display panel units that eliminate waste in erection and installation.
3. Display panel members capable of forming slotted panels that are identical on both sides, thereby doubling the use of the panels.
4. Such panel members that may form slotted panels of unlimited lengths and heights; also with horizontal and vertical curves on long radiuses.
5. Panel members of a structure that they may be formed by extrusion at low cost from light weight metals and plastics.
6. Article display panel units that are easy to assemble and simple to install.
7. Such panel units that can accept concealed groove lighting with available tubular light fixtures to produce dramatic displays.

8. Panel members that can be provided with concave, convex, bareface or contoured surfaces in standard or random widths and in corner or end configurations.
9. Article display units that can present any colored, polished, mirrored, embossed or other desired surface.
10. Article display units suitable for heavy duty applications because of the strength of construction materials and internal configuration.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished, in part, according to the present invention by the provision of members for use in forming article display units that comprise first and second rectangular webs having lengths substantially greater than their widths, a third web integral with the first and second webs perpendicular thereto fixing the first and second webs spaced apart and parallel to one another. The members further comprise an integral leg element extending laterally from the first web in the direction of the second web and a lug element extending laterally from the second web in the direction of the first web. The leg and lug elements are structured to interlock with each other.

The objects are further accomplished by forming article display units containing a plurality of parallel slots in an exterior surface by fixing together a plurality of the above described members by interlocking a leg element of one with the lug element of another. The resulting display units may be free-standing in a support base or may be wall-mounted. Article support devices, e.g., brackets, hooks, etc., are hooked to the slotted display units via the slots therein.

A basic panel member of the invention has first and second webs substantially identical in size and shape except for the leg and lug elements extending normally therefrom. In preferred forms, the longitudinal sides of the first and second webs are C-shaped.

Another form of the new panel members designed for creating ends upon the display units has a second web shorter in width than the first web from which the lug element depends adjacent the longitudinal side of the second web that extends beyond the first web.

Another form of the panel members designed for creating corners in the display units has the first web divided into a first portion and a second portion normal thereto. A Y-shaped element extends from the first web at the joint of its first and second portions at a 45° angle relative to the flat portions.

The first and second webs of the panel members may be curved as well as flat. Also, the first web may be partially contoured, e.g., provided with a convex face, concave face, embossed face, grooved portions to engage decorative inserts, etc.

BRIEF DESCRIPTION OF THE DRAWINGS

A more complete understanding of the invention may be had by reference to the accompanying drawings in which.

DESCRIPTION OF PREFERRED EMBODIMENTS

Figure 1:
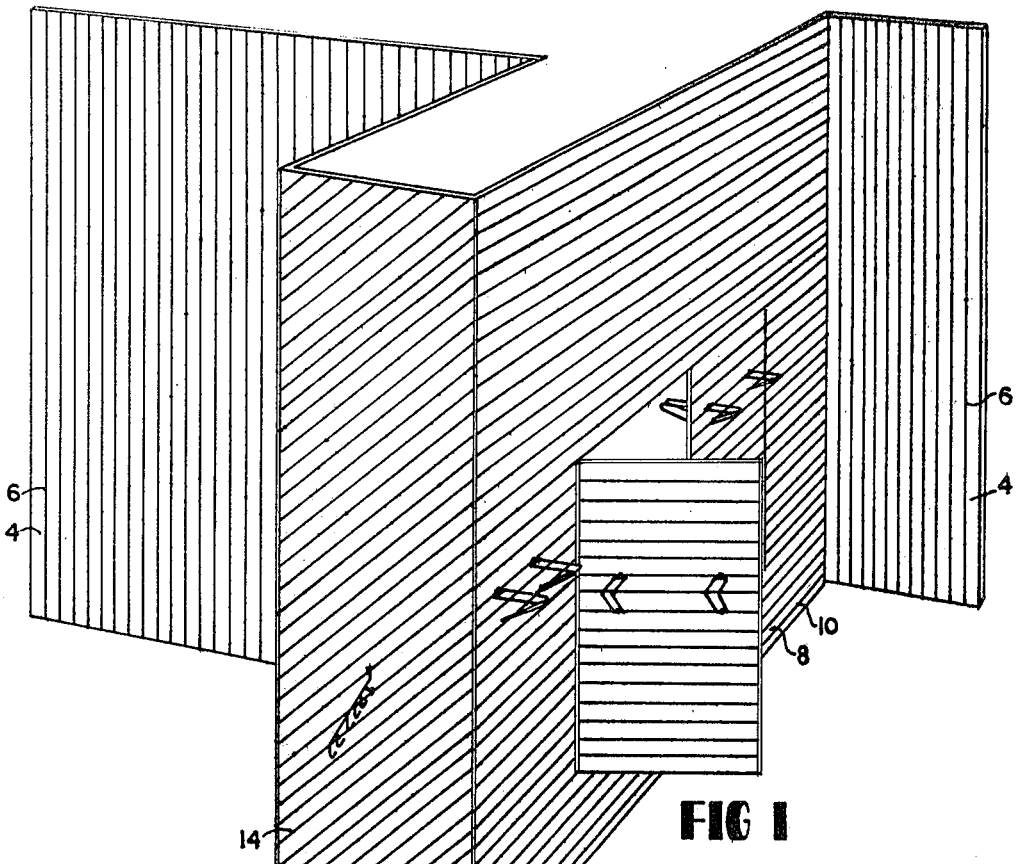
FIG. 1 is an isometric view of a wall-mounted article display unit of the invention comprising both horizontal, vertical and diagonal parallel support slots, including a panel hinged with flush hinges.

Referring in detail to the drawings, the article display unit 2 of FIG. 1 comprises panels 4 with vertical slots 6, a panel 8 with horizontal slots 10 and a panel 12 with diagonal slots 14.

Figure 2:
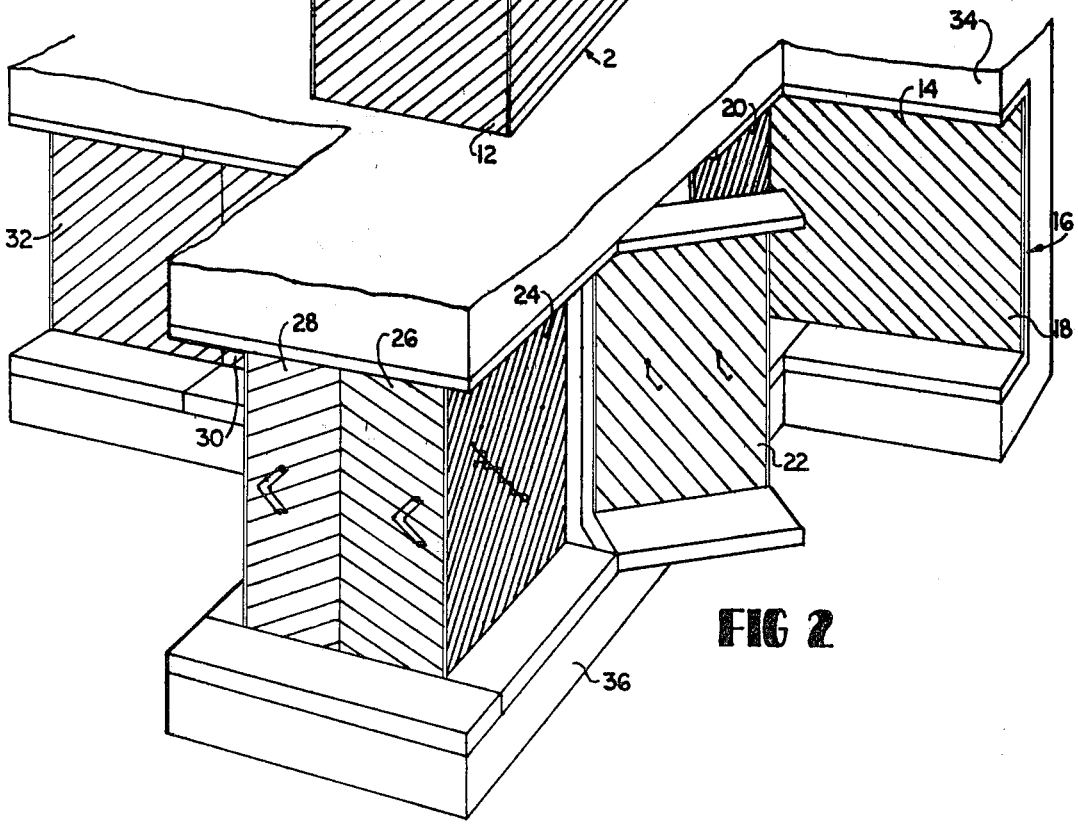
FIG. 2 is an isometric view of another wall-mounted article display unit comprising hinged panels formed of panel members of the invention.
Figure 3:
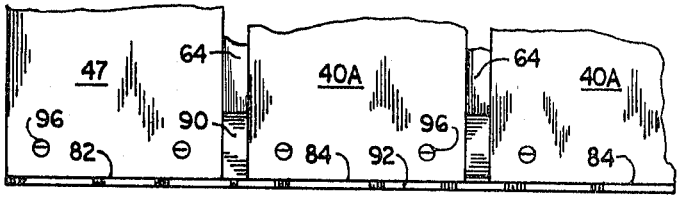
FIG. 3 is a fragmentary front elevation of the bottom portion of an article display unit of the invention.

The article display unit 16 of FIG. 2 comprises panels 18, 20, 22, 24, 26, 28, 30 and 32 all containing diagonal slots 14. The unit 16 also comprises the cornice 34, a base platform 36 and hinge means (not shown) for the panel 22. The panels of the units 2 and 16 are formed of special panel members provided by the invention as described in more detail below.

Figure 4:
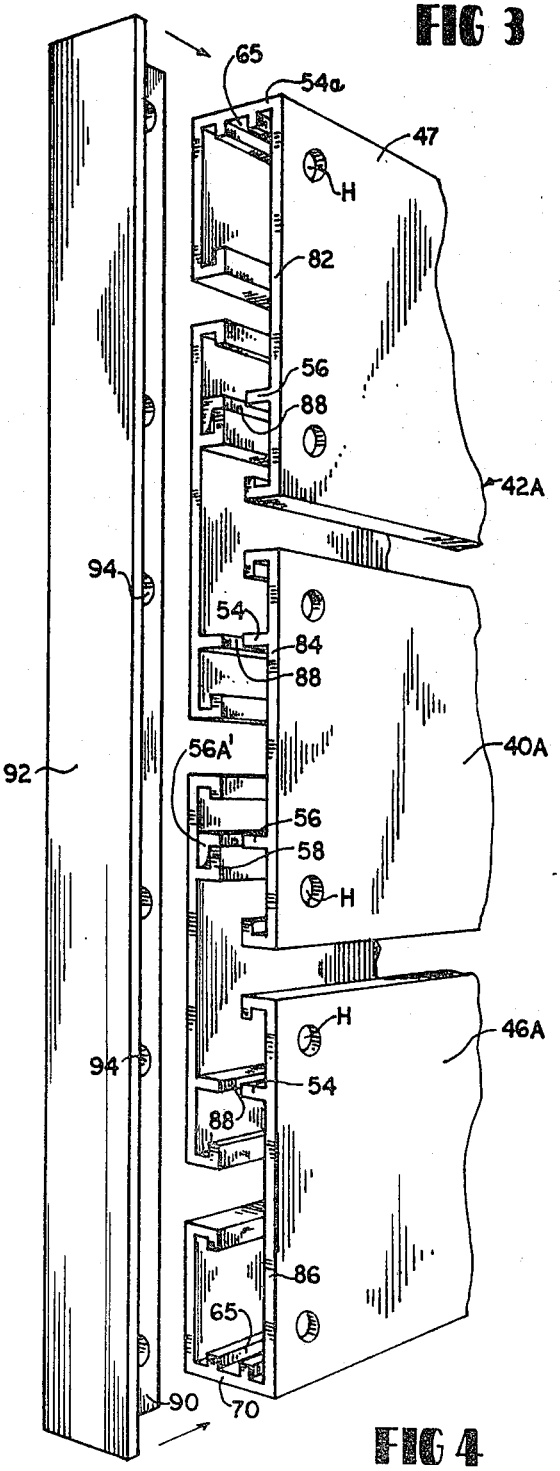
FIG. 4 is an exploded fragmentary end view of a wall-mounted article display unit of the invention.
Figure 5:
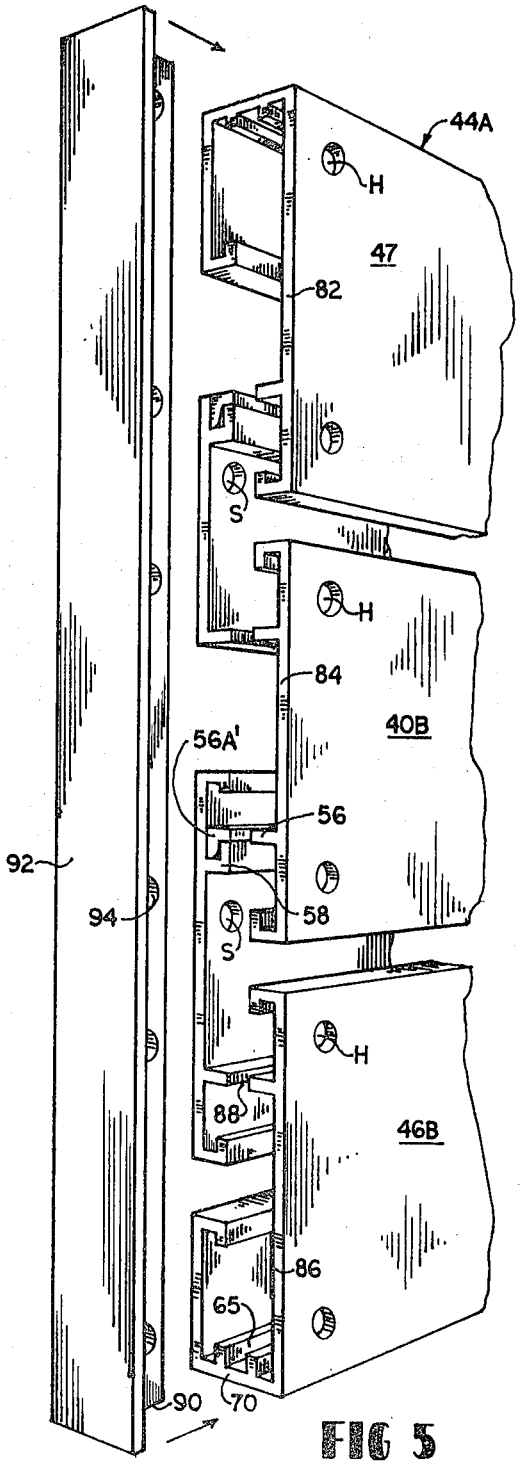
FIG. 5 is an exploded fragmentary view of a free-standing article display unit of the invention.
Figures 6, 7, 8, 8A, 9, 10, 11, 12, 13, 14, 15, 16, 17:
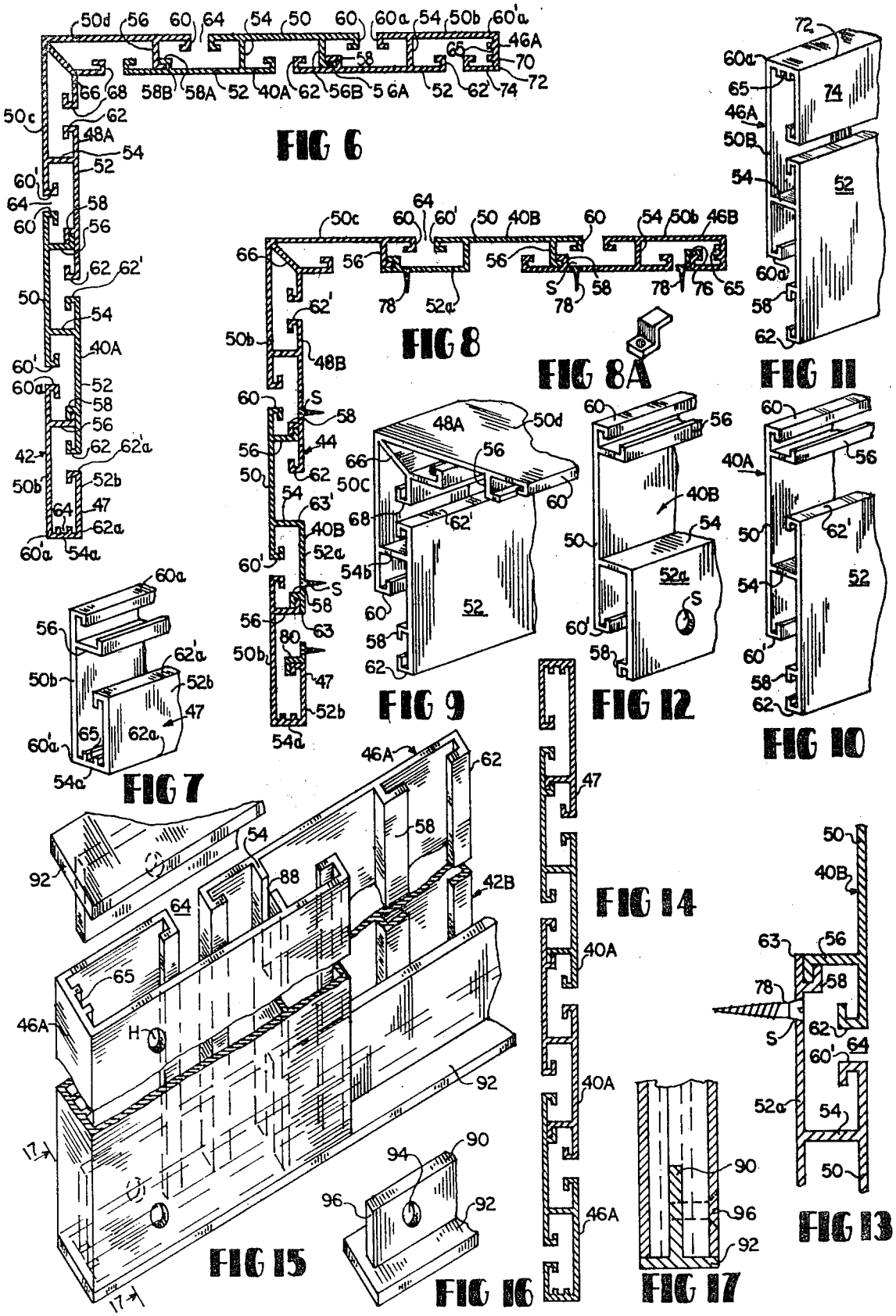
FIG. 6 is a sectional view of a free-standing article display unit of the invention.
FIG. 7 is an enlarged, fragmentary, isometric view of the bottom portion of the unit shown in FIG. 6.
FIG. 8 is a sectional view of a wall-mounted article display unit of the invention.
FIG. 8A is an isometric view of a clip element for use in assembly of wall-mounted display units of the invention.
FIG. 9 is an enlarged, fragmentary, isometric view of the corner portion of the unit shown in FIG. 6.
FIG. 10 is an enlarged, fragmentary, isometric view of a middle portion of the unit shown in FIG. 6.
FIG. 11 is an enlarged, fragmentary, isometric view of the end portion of the unit shown in FIG. 6.
FIG. 12 is an enlarged, fragmentary, isometric view of the middle portion of the unit shown in FIG. 8.
FIG. 13 is an enlarged, fragmentary, sectional view of a portion of the unit shown in FIG. 8.
FIG. 14 is a sectional view of a free-standing article display unit of the invention.
FIG. 15 is a fragmentary, isometric view, partly in section, of cap portions of display units of the invention.
FIG. 16 is a fragmentary, detail view of an end cap for the new display units.
FIG. 17 is a sectional view taken on the line 17—17 of FIG. 15.

The major areas of display units of the invention, e.g., units 2 & 16, are formed of inside panel members of two types that are basically the same, namely, panel members 40A used to form free-standing display units 42 (FIGS. 4 & 6) and panel members 40B used to form wall-mounted display units 44 (FIGS. 5 & 8).

A second type of panel members of the invention are the end type, namely, panel members 46A & 47 for the ends of free-standing units such as unit 42 and end panel members 46B & 47 for the ends of wall-mounted units such as unit 44. The member 46B is identical to member 46A except for the screw holes S.

A third type of panel member of the invention is the corner type, namely, panel members 48A for the corners of free-standing units such as unit 42 and corner panel members 48B for corners of wall-mounted units such as unit 44. Members 48B are identical to members 48A except for screw holes S.

Regardless of whether a panel member is an inside type, corner type or end type, they all are formed of certain basic elements. With reference to panel member 40A (FIGS. 6 & 10), it comprises a first rectangular web 50 having a length substantially greater than its width, a second rectangular web 52 having a length equal to the length of web 50 and a width less than that length and a third web 54 integral with webs 50 & 52 and perpendicular thereto fixing the webs 50 & 52 in spaced apart, parallel position. The member 50A further comprises an integral leg element 56 extending laterally from web 50 in the direction of web 52 and an integral lug element 58 extending laterally from web 52 in the direction of web 50. The leg element 56 is structured to interlock with a lug element 58 of an adjacent panel member, e.g., the corner member 48A.

The leg elements 56 and lug elements 58 are preferrably L-shaped, i.e., the leg elements 56 are formed of a base element 56A and a lateral element 56B and the lug elements also have a base element 58A and lateral element 58B. The base element 56A' (see FIGS. 4 & 5) may be tapered to assist in the interlocking of the leg elements 56 with lug elements 58.

The leg elements 56 extend a greater distance from the webs 50 than the lug elements 58 extend from the webs 52.

The longitudinal edges 60 & 60' of the webs 50 are preferrably C-shaped as are the longitudinal edges 62 & 62' of webs 52. The inside panel members 40B differ from the inside panel members 40A because they include screw holes H and the longitudinal edges 63 and 63' are less extended from the elements 54 and 58 than are the edges 62 and 62'. Actually, the members 40A and 40B could be identical, but the difference in the edges 63 & 63' vs. 62 & 62' save metal or other material from which the members 40B are constructed.

The leg elements 56 are set back from the respective longitudinal edges 60 of webs 50 an appreciable distance as are lug elements 58 from the longitudinal edges 62 of webs 52 so that when a leg element 56 is interlocked with a lug element 58 of another panel member, e.g., member 48A, slots 64 are formed between the adjacent panel members. These slots may be, in a final display unit 2, vertical slots 6, horizontal slots 10 or diagonal slots 14.

With the inside panel members 40A, the webs 50 are equal in width to the webs 52 and the web 54 connects to web 52 back away from the longitudinal edge 62'. With the inside panel members 40B, the web 50 is wider than the web 52*a* in order to save construction material as aforesaid.

With the end panel members 47, the webs 50*b* are wider than the webs 52*b* and the third web 54*a* connects to webs 50*b* and 52*b* along their longitudinal sides 60'*a* and 62*a* respectively. The longitudinal sides 60*a* and 62'*a* of webs 50*b* and 52*b* respectively are C-shaped. The member has a leg element 56, does not include a lug element, but does have a channel element 65 integral with web 54*a*.

The end panel members 46A & 46B include a lug element 58, but no leg element. Also the first web 50*b* is narrower than the second web 52. A fourth web 70 extends laterally from the longitudinal edge 60'*a* of web 50*b* and joins the longitudinal edge 72 of the L-shaped member 74. A channel 65 is formed integral with the web 70.

In the corner panel members 48A and 48B, the first web comprises a first flat portion 50*c* and a second flat portion 50*d* normal to portion 50*c*. The third web 54 extends from the portion 50*c* and the leg element 56 extends from portion 50*d*. The second web 52*b* is fixed apart and parallel to the portion 50*c* by the web 54. There is also a Y-shaped element 66 that extends from the first web at the joint of the first flat portion 50*c* with the second flat portion 50*d* at an angle of approximately 45° relative to both flat portions. The free ends 68 of Y-element 66 are preferrably C-shaped, as are the longitudinal edges 60 and 60' of the first web flat portions 50*d* and 50*c* respectively.

To assemble a wall-mounted display unit such as unit 44, an S-shaped clip 76 (see FIG. 8A) is fixed to a wall (not shown) by a screw 78 and an end member 46B is slipped under the clip 76 as shown in FIG. 8. A second screw 78 is next screwed through the hole S of the member 46B and then the leg element 56 of an inside member 40B is locked into the lug element 58 of the member 46B. A screw is screwed through the hole S of member 40B and then the leg element 56 of the corner member 48B is locked into the lug element 58 of member 40B. Next a screw is screwed through hole S of corner member 48B and the leg element 56 of member 40B is locked into the lug element 58 of member 48B. Finally, a screw is screwed through the hole S of member 40B, a Z-shaped clip 80 is screwed to the wall (not shown) a measured distance from the edge 63 of member 40B and end member 47 is slipped under the clip 80 and the leg element 56 of member 47 is locked into the lug element 58 of member 40B. This completes the wall mounting of the display unit 44 in which the heads of the screws 78 are substantially hidden from view. Display units of most any desired size may be assembled and wall mounted using the stepwise procedure as described.

The assembly of free-standing and wall-mounted display units from the new panel members of the invention is further illustrated by FIGS. 3–5 and 15–17.

In order to finish or close-off the transverse edges of display units, cap strips are used. FIG. 5 shows a wall-mounted unit 44A (without mounting screws installed) comprising panel member 47 with its transverse edge 82, member 40B with its transverse edge 84 and member 46B with its transverse edge 86. Holes H are punched or drilled in the members 47, 40B and 46B near the transverse edges and slots 88 are cut in the ends of the webs 54 and leg elements 56 present in the assembly to a depth at least as deep as the length of the leg 90 of the T-shaped end cap 92. Holes 94 are preformed in the leg 90 to correspond to the spacing of holes H and the transverse edges 96 of the leg 90 are cut back the width of the webs 54*a* and 70 (see FIG. 16). As a result, the end cap 92 can be inserted in the direction of the arrow in FIG. 4 into the end of the unit 44A to provide a closed or finished appearance. The cap 92 can be held in place by self-tapping screws 96 or other fasteners as shown in the horizontally positioned cap 92 in FIG. 3.

The free-standing display unit 42A of FIG. 4 is assembled from panel members 47, 40A and 46A and closed with an end cap 92 in the same manner described above for unit 44A.

FIG. 15 illustrates the assembly of a free-standing display unit 42B with vertical slots 62 and end caps 92 in the horizontal position.

Figure 22:
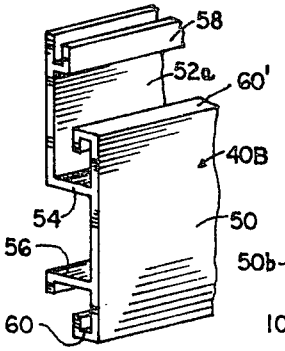

FIGS. 18–23 illustrate various ways in which the outside surfaces of panel members of the invention are structured. By way of example, FIGS. 18–23 show inside panel members for wall-mounted units, e.g., member 40B in FIG. 22 is identical to member 40B in FIG. 8, but the surface structuring can be applied to any of the other panel members 40A, 46A, 46B, 47, 48A and 48B.

Figure 18:
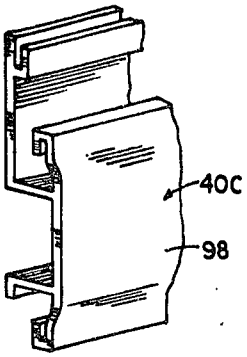
FIGS. 18–23 are fragmentary, isometric end views of different embodiments of panel members of the invention.
Figure 19:
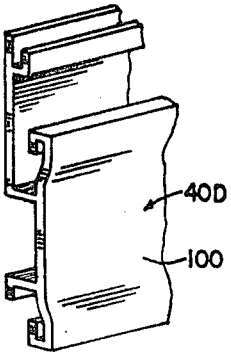
Figure 20:
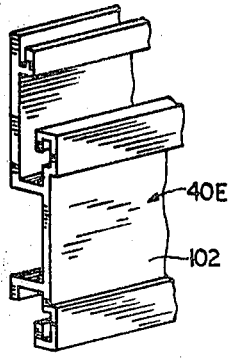
Figure 21:
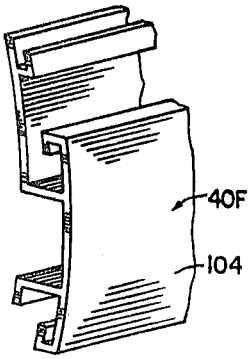

In FIG. 18, the panel member 40C has a convex surface portion 98. In FIG. 19, the panel member 40D has a concave surface portion 100. In FIG. 20, the panel member 40E has an indent surface portion 102 and in FIG. 21, the panel member 40F has a slightly bowed surface 104.

Figure 23:
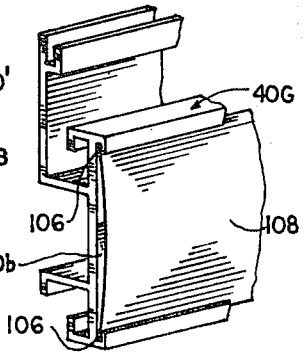

The panel member 40G in FIG. 23 illustrates a further surface modification, i.e., it has side grooves 106 in the web 50*b* into which surface strips 108 may be inserted and held. Such strips can be plastic, metal, paper or other rigid or simi-rigid material of any desired color, surface finish, etc.

As previously indicated, the new article display units provide parallel slots into which various forms of clips, hooks or other mounting devices may be inserted and held for supporting, directly or indirectly, any desired article. Some preferred forms of accessory clips of the invention are illustrated in FIGS. 24–34.

The free-standing display unit 42 has a single bracket accessory clip 110 mounted on surface 112 and a double bracket accessory clip 114 mounted on surface 116. Elongated electric light tubes L may be included in the display units to provide additional dramatic effects.

The accessory clip 110 comprises a bolt 118, nut 120, clamp 122 and single opening bracket 124. The bolt 118 has a knurled head 126 with hex wrench recess 128. The nut 120 comprises threaded ring portion 130, wing portion 132 and ledge portion 134. The clamp 122 comprises rear face section 136, front face section 138, holes 140 and arcuate portion 142.

Figure 24:
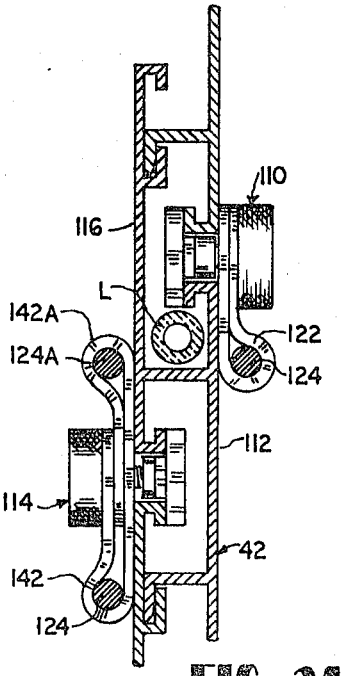
FIG. 24 is a sectional view showing accessory clip assemblies of the invention.
Figure 25A:
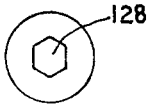
FIG. 25A is an end view of an accessory T-bolt of the invention.
Figure 25B:
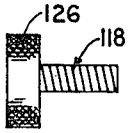
FIG. 25B is a lateral view of the T-bolt of FIG. 25A.
Figure 26:
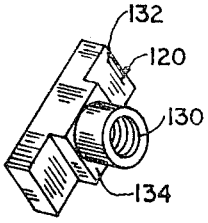
FIG. 26 is an isometric view of an accessory clip T-nut of FIG. 24.
Figure 27:
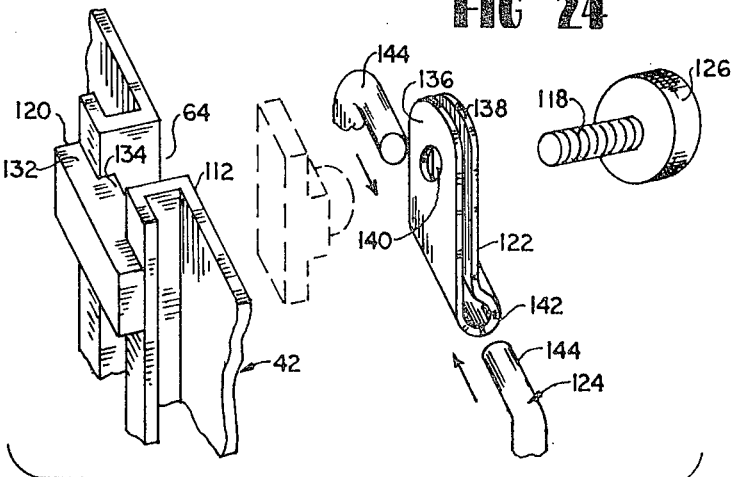
FIG. 27 is an exploded view of an accessory clip assembly of the invention illustrating how such items are installed in the display units of the invention.

The free ends 144 of bracket 124 slip into the arcuate portion 142 of clamp 122, bolt 118 in partly threaded into nut 120, this, in turn, is inserted into the slot 64 (in the position shown in broken line in FIG. 27), twisted to bridge slot 64 with wing portion 132 (see FIG. 27) and the bolt is then tightened to close the clamp 122 about the bracket ends 144 (see FIG. 24).

The double bracket clip 114 is similar to clip 122, but has two clamp portions 142 and 142A in which two brackets 124 and 124A are held.

Figure 28:
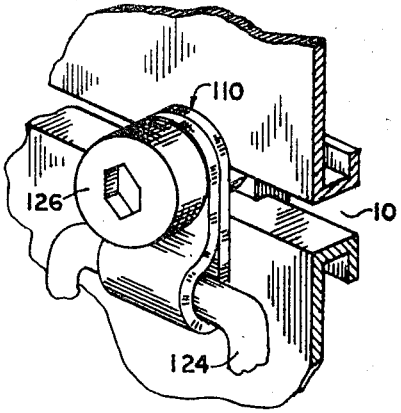
FIG. 28 is an enlarged, fragmentary view of an accessory clip of the invention, horizontally mounted in a display unit of the invention.
Figure 29:
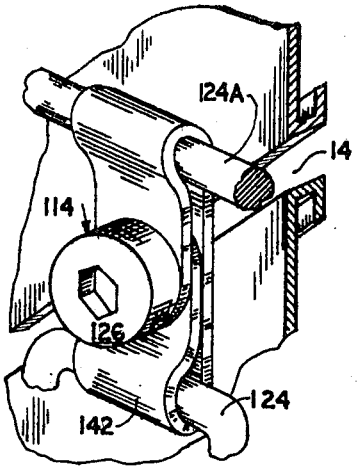
FIG. 29 is an enlarged, fragmentary view, partly in section, of another embodiment of an accessory clip of the invention, diagonally mounted.
Figure 30:
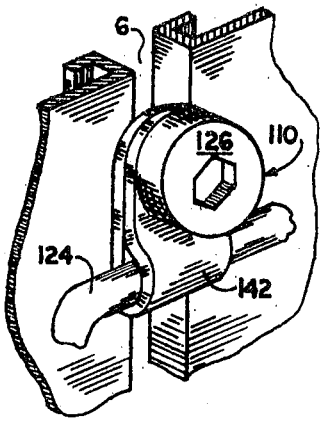
FIG. 30 is an enlarged, fragmentary view, partly in section, of a clip like that of FIG. 28, but mounted in a vertical slot of a display unit of the invention.
Figure 34:
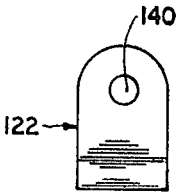
FIG. 34 is a plan view of the assembly clip of FIG. 33.
Figure 33:
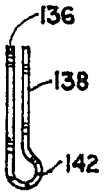
FIG. 33 is an end view of a single assembly clip of the invention.
Figure 32:
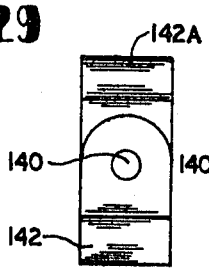
FIG. 32 is a plan view of the assembly clip of FIG. 31.
Figure 31:
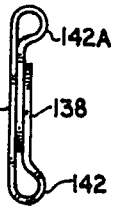
FIG. 31 is an end view of a double assembly clip of the invention.

FIGS. 28–30 illustrate how the accessory clips 110 and 114 may be mounted in horizontal slots 10, diagonal slots 14 and vertical slots 6.

Figure 35:
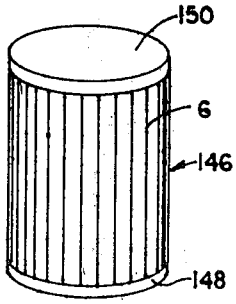
FIG. 35 is an isometric view of a drum shaped article display unit of the invention.
Figure 36:
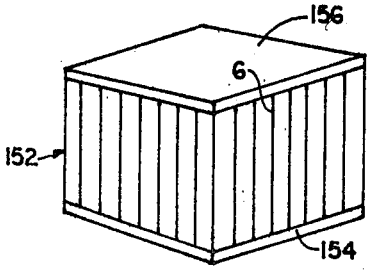
FIG. 36 is an isometric view of a cube shaped article display unit of the invention.

In addition to closing the exposed ends of display units with end slips 92, other closure devices may be used as shown in FIGS. 35 and 36. Thus, the circular display unit 145 with vertical slots 6 comprises a base disc plate 148 and top disc plate 150 and the cubic display unit 152 with vertical slots 6 comprises a square base plate 154 and a square top plate 156.

Figure 39:
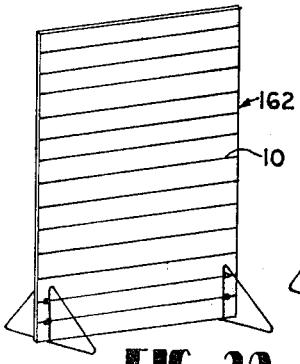
FIG. 39 is an isometric view similar to FIGS. 37 and 38 of yet another embodiment of the new display units.
Figure 38:
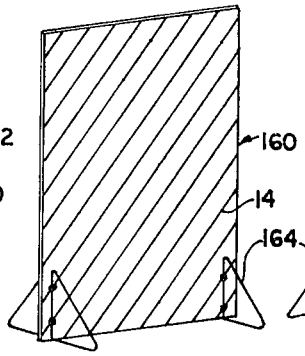
FIG. 38 is an isometric view similar to FIG. 37 of another embodiment of the new display units.
Figure 37:
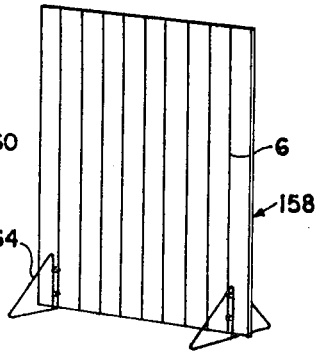
FIG. 37 is an isometric view of a free-standing, rectangular shaped article display unit of the invention.

FIGS. 37–39 illustrate how free-standing display units may be varied in slot positioning, e.g., unit 158 has vertical slots 6, unit 160 has diagonal slots 14 and unit 162 has horizontal slots 10. These units have triangular feet elements 164 to hold them in an upright position.

The embodiments of the invention in which an exclusive property or privilege is claimed are defined as follows:

1. A member for use in forming an article display unit which comprises:

a first rectangular web having a length substantially greater than its width, a second rectangular web having a length substantially greater than its width, said first and second webs being spaced apart parallel to each other with only a minor portion of the first web overlapping an equivalent portion of the second web, a third web integral with said first and second webs and perpendicular thereto fixing said first and second webs in said spaced apart, parallel position, an integral leg element extending laterally from said first web intermediate the longitudinal edges thereof in the direction of said second web, an integral lug element extending laterally from said second web intermediate the longitudinal edges thereof in the direction of said first web and spaced apart from said leg element, said leg element being structured to interlock with a portion of a lug element of another of said members.

2. The member of claim 1 wherein said leg element and said lug element are both L-shaped.

3. The member of claim 2 wherein the base of said L-shaped leg element is tapered.

4. The member of claim 2 wherein the exterior surface of at least one of said first and second webs have grooves into which a decorative sheet may be inserted.

5. The member of claim 2 wherein said first and second webs are flat.

6. The member of claim 2 wherein said first and second webs are substantially identical in shape except for the leg and lug elements extending therefrom respectively.

7. The member of claim 1 wherein the length of said leg element is substantially equal to the length of said third web.

8. The member of claim 1 wherein said first and second webs are curved.

9. A member for use in forming an article display unit which comprises:

a first rectangular web having a length substantially greater than its width, a second rectangular web having a length substantially greater than its width, said first and second webs being spaced apart parallel to each other with only a minor portion of the first web overlapping an equivalent portion of the second web, a third web integral with said first and second webs are perpendicular thereto fixing said first and second webs in said spaced apart, parallel position, an integral leg element extending laterally from said first web in the direction of said second web, an integral lug element extending laterally from said second web in the direction of said first web and spaced apart from said leg element, said leg element extending from said first web a greater distance than said lug element extends from said second web, and said leg element being structured to interlock with a portion of a lug element of another of said members.

10. A member for use in forming an article display unit which comprises:

a first rectangular web having a length substantially greater than its width with C-shaped longitudinal edges, a second rectangular web having a length substantially greater than its width with C-shaped longitudinal edges, said first and second webs being spaced apart parallel to each other with only a minor portion of the first web overlapping an equivalent portion of the second web, a third web integral with said first and second webs and perpendicular thereto fixing said first and second webs in said spaced apart, parallel position, an integral leg element extending laterally from said first web in the direction of said second web, an integral lug element extending laterally from said second web in the direction of said first web and spaced apart from said leg element, said leg element being structured to interlock with a portion of a lug element of another of said members.

11. An article display unit formed of a plurality of members that comprise:

a first rectangular web having a length substantially greater than its width, a second rectangular web having a length substantially greater than its width, said first and second webs being spaced apart parallel to each other with only a minor portion of the first web overlapping an equivalent portion of the second web, a third web integral with said first and second webs and perpendicular thereto fixing said first and second webs in said spaced apart, parallel position, an integral leg element extending laterally from said first web in the direction of said second web, an integral lug element extending laterally from said second web in the direction of said first web and spaced apart from said leg element, said leg element being structured to interlock with a portion of a lug element of another of said members, said members being fixed together by the interlocking of a leg element of one member into the lug element of another member thereby creating an article display unit containing a plurality of parallel slots in an exterior surface thereof.

12. An article display unit of claim 11 that is supported as a free-standing unit by a base into which said panel is inserted.

13. An article display unit of claim 11 having article support devices hooked to said panel through said slots thereof.

14. A member for use in forming an article display unit which comprises:

a first rectangular web having a length substantially greater than its width, a second rectangular web having a length substantially greater than its width, the lengths of said first and second webs being equal and the width of said second web being less than the width of said first web, said first and second webs being spaced apart parallel to each other with only a minor portion of the first web overlapping an equivalent portion of the second web, a third web integral with said first and second webs and perpendicular thereto fixing said first and second webs in said spaced apart, parallel position, an integral leg element extending laterally from said first web in the direction of said second web, an integral lug element extending laterally from said second web in the direction of said first web and spaced apart from said leg element, said leg element being structured to interlock with a portion of a lug element of another of said members.

15. The member of claim 14 wherein said leg element depends from said first web and said lug element depends from said second web.

16. The member of claim 15 wherein the longitudinal edges of said first web are C-shaped.

17. The member of claim 16 wherein said third web connects to said second web along a first longitudinal side thereof and said lug element depends from said second web adjacent the second longitudinal side thereof.

18. The member of claim 16 wherein said first web comprises a first flat portion and a second flat portion normal to said first flat portion creating a corner piece for article display units formed therefrom.

19. The member of claim 18 wherein a Y-shaped element extends from said first web at the joint of said first flat portion with said second flat portion at approximately a 45° angle relative to both said flat portions.

20. The member of claim 14 wherein the longitudinal edges of said first and second webs are C-shaped.

* * * * *